United States Patent [19]

Hild

[11] 4,292,510

[45] Sep. 29, 1981

[54] KEYBOARD FOR A MINIATURE CALCULATOR

[76] Inventor: Manfred Hild, Staibenäcker 24, D-7000, Stuttgart 1, Fed. Rep. of Germany

[21] Appl. No.: 20,725

[22] Filed: Mar. 15, 1979

[30] Foreign Application Priority Data

Mar. 28, 1978 [DE] Fed. Rep. of Germany ..... 2813234
Sep. 23, 1978 [DE] Fed. Rep. of Germany ..... 2841463

[51] Int. Cl.[3] ..... G06C 7/02
[52] U.S. Cl. ..... 235/145 R
[58] Field of Search ..... 235/145 R, 146, 127; 340/365 S, 365 A; 200/5 A, 5 R; 58/152 R; 234/123-125

[56] References Cited

U.S. PATENT DOCUMENTS 2,117,398 5/1938 Brown, Jr. ..... 235/127 X
3,517,637 6/1970 Kaiser ..... 235/145 R
3,860,771 1/1975 Lynn et al. ..... 235/145 R
4,120,039 10/1978 Fischer ..... 200/5 A

OTHER PUBLICATIONS

"Optical Keyboard" by Sharp and Owen, IBM Tech. Disc. Bulletin, vol. 5, No. 10, Mar. 1963, p. 127.

*Primary Examiner*—L. T. Hix
*Assistant Examiner*—Benjamin R. Fuller
*Attorney, Agent, or Firm*—Spencer & Kaye

[57] ABSTRACT

A calculator keyboard includes a face plate and a plurality of keys supported in a predetermined location with respect to the face plate. In the face plate there are provided narrow recesses in alignment with respective keys. Each recess has a width dimension sufficient for providing access to the associated key by a fingernail of the user.

12 Claims, 8 Drawing Figures

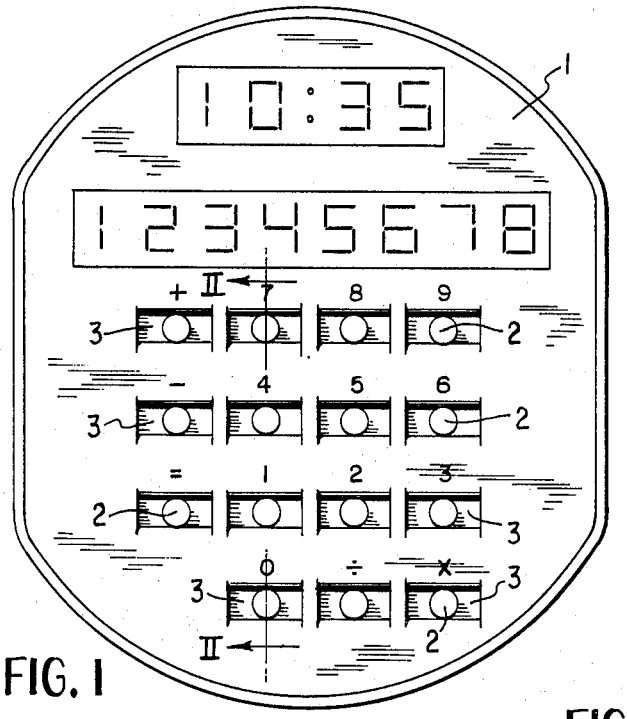
FIG. 1
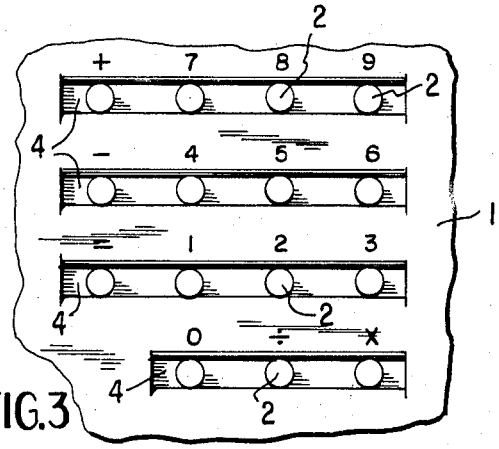
FIG. 3
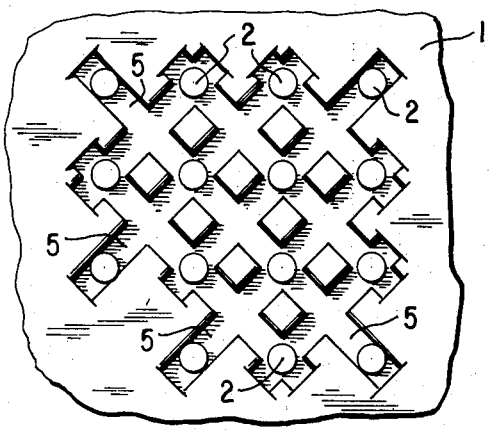
FIG. 4
FIG. 2
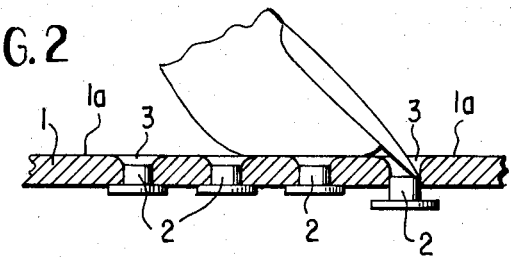
FIG. 5
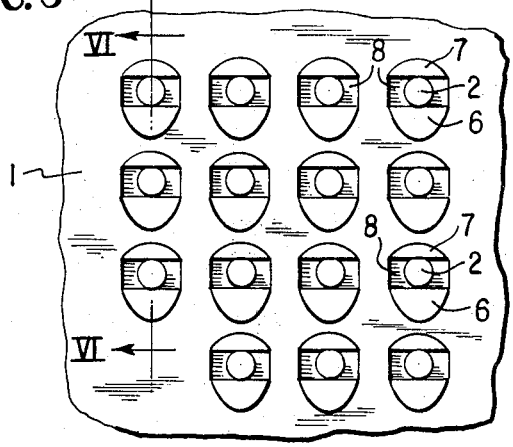
FIG. 7
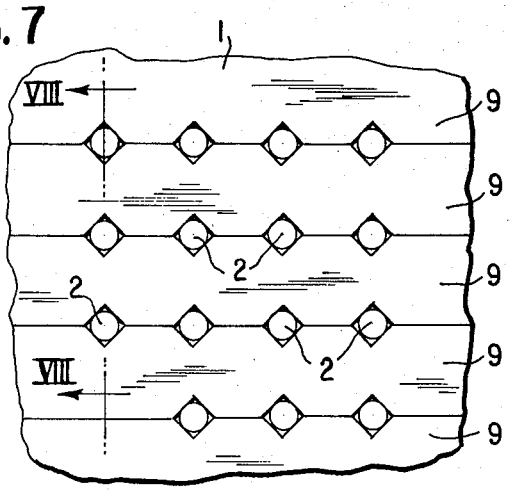
FIG. 6
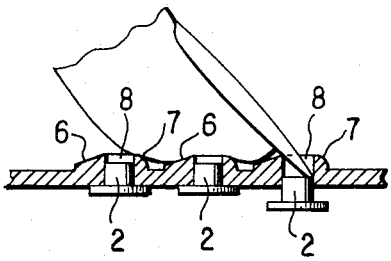
FIG. 8
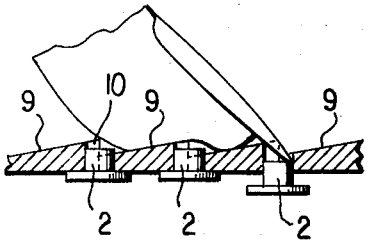

KEYBOARD FOR A MINIATURE CALCULATOR

BACKGROUND OF THE INVENTION

This invention relates to a keyboard for electronic calculators, particularly miniature calculators incorporated, for example, in wristwatches. Such a miniature calculator is manufactured, for example, by SEIKO (Japan) under the designation "FH-001 Digital Calculator" or by EMEX AG (Switzerland).

The progressive reduction in the size of electronic calculators has made it increasingly difficult o operate the keyboards with the bare finger of the user. Thus, a point has already been reached where a secure actuation of the selected keys of miniature calculators are possible only with an auxiliary instrument such as a pencil tip or a tool of similar configuration. A disadvantage of this arrangement resides in the inconvenience involved with the necessity of using an additional tool which may not be always immediately available. A further disadvantage is considered to reside in the risks of damaging the calculator by hard tools or by soiling it, for example, by graphite particles that could break off a pencil.

SUMMARY OF THE INVENTION

It is an object of the invention to provide an improved keyboard, particularly for miniaturized electronic calculators, which can be operated by the user without resorting to an auxiliary tool.

More particularly, it is an object of the invention to provide an improved keyboard, particularly for a miniaturized electronic calculator in which the individual keys may be operated by a fingernail of the user.

These objects and others to become apparent as the specification progresses, are accomplished by the invention, according to which, briefly stated, the keyboard comprises a fixed support face engageable by the user's finger tip and keys arranged in recesses in the support face. For operation, the user may place a finger tip on the support face adjacent to the key to be actuated and by pivoting his finger about the support face as a fulcrum, may cause his fingernail to penetrate into the recess and thus depress the desired key.

It is an advantage of the invention that keys of reduced surface may be actuated by the user in an error-free manner without an additional tool, thus eliminating the above-discussed disadvantages.

BRIEF DESCRIPTION OF THE DRAWINGS

FIG. 1 is a schematic top plan view, on an enlarged scale, of a calculator incorporating a preferred embodiment of the invention.

FIG. 2 is a schematic sectional view taken along line II—II of FIG. 1, showing one component in the actuated state.

FIG. 3 is a schematic top plan view, on an enlarged scale, of another preferred embodiment of the invention.

FIG. 4 is a schematic top plan view of still another preferred embodiment of the invention.

FIG. 5 is an enlarged fragmentary schematic top plan view of a further preferred embodiment of the invention.

FIG. 6 is a sectional view taken along line VI—VI of FIG. 5, showing one component in the actuated state.

FIG. 7 is an enlarged fragmentary schematic top plan view of still another preferred embodiment of the invention.

FIG. 8 is a sectional view taken along line VIII—VIII in FIG. 7, showing one component in the actuated state.

DESCRIPTION OF THE PREFERRED EMBODIMENTS

Turning now to FIG. 1, there is shown, in a schematic illustration, the top face of an electronic calculator, such as a miniaturized calculator incorporated in a wristwatch. The top face is divided into a display portion which may indicate separately the time and the calculations performed and a keyboard situated in the area below the display.

The keyboard comprises a rigid plate 1 which, at the same time, may constitute the entire top face of the watch-calculator assembly. The keyboard further comprises a plurality of keys 2 to be individually actuated. Conventionally, the plate 1 carries identifications for each key. Such identifications are shown in FIG. 1 only for the digit keys 0 to 9. The structure of the keys 2, particularly their contact-making arrangement is conventional and is therefore not described in more detail.

Also referring now to FIG. 2, according to the invention, the keys 2 are arranged for being actuated by the user's fingernail. For this purpose with each key 2 there is associated a slot 3 aligned with the respective key 2. As shown in FIG. 2, each key may have an upper stem portion which normally (that is, in the non-actuated state) projects from below into its respective slot, but does not protrude beyond the upper face (support surface) 1*a* of the plate 1. It is feasible, however, to so arrange the keys that even in the normal (non-actuated) state they do not extend into their respective slot. Each slot 3 has a length dimension and a width dimension measured transversely to and being smaller than the length dimension. The area defined by the length and width dimensions of each slot 3 as well as the thickness of the plate 1 are such that the fingernail of the user can easily penetrate thereinto and depress the key 2, as shown for the extreme right-hand key 2 in FIG. 2. On the other hand, however, the finger tip of the user positioned over a slot should gain no access to the key associated with that slot, as may be observed for the key 2 which is second from the right in FIG. 2.

Thus, for depressing, for example, the right-hand key 2 as shown in FIG. 2, the user places his finger tip on the support face 1*a* which is adjacent that key and which forms part of the plate 1, and then rocks his finger slightly, fulcrumating it about the support face 1*a*, so that his fingernail penetrates into the slot 3 and depresses the key 2. As it may be further observed in FIGS. 1 and 2, each key has an outline that extends over substantially the entire width dimension of the slot with which it is associated, so that the user's fingernail is effectively prevented from slipping off the key and into the slot as depression of the key is effected.

Turning now to FIG. 3, the embodiment shown therein differs from the previously discussed embodiment only in that continuous slots 4 are provided, each extending over a plurality of keys 2. Advantages of this embodiment reside in a simpler manufacture as well as a better adaptation to various fingernail dimensions and configurations.

Turning now to FIG. 4, the embodiment shown therein differs from the FIG. 3 embodiment only in that the continuous slots are diagonally extending, criss-crossing slots 5. The keys 2 are situated at the intersection of two slots 5.

According to the embodiment illustrated in FIGS. 5 and 6, the face plate of the calculator is so designed that it has separate elevated parts 6 associated with each key 2. Each elevated part 6 slopes upwardly towards the associated key 2 and is adapted to serve as a rigid support face for the finger tip of the user. Each elevated part 6 is complemented by a ridge 7 situated at the other side of the associated key 2 at a small distance from the part 6 to form therewith a recess 8, into which the user's fingernail may penetrate for depressing the key 2 aligned with the recess, as shown in FIG. 6. The ridges 7 protect the keys 2 from lateral exposure in their non-actuated state and they also serve for guiding the user's fingernail.

Turning now to the embodiment illustrated in FIGS. 7 and 8, the horizontal rows of the keys 2 are separated by inclined support surfaces 9. From row to row, each support surface 9 slopes upwardly towards the consecutive row of keys 2 as particularly well seen in FIG. 8. It is noted that in the FIG. 8 illustration, each key 2 represents a key belonging to a different row. The adjoining support surfaces 9 are spaced from one another such that between them a recess 10 is defined through which the user's fingernail may project and depress the selected key as his finger tip rests on the support surface 9 rising towards the keys 2 on the associated key row. The mode of actuation is illustrated in FIG. 8 for a key 2 which belongs to a key row second from the right.

While in all of the above-described embodiments the contacting member is identified as a key 2, it is to be understood that in most embodiments the individual keys 2 may be readily replaced by a locally deformable, conventional, continuous contact foil.

While in all the embodiments the recesses or slots are linear, it is to be understood that they may be of curving course for more closely following the general curvature of the nail as seen in end view.

It is to be understood that the above description of the present invention is susceptible to various modifications, changes and adaptations and the same are intended to be comprehended within the meaning and range of equivalents of the appended claims.

What is claimed is:

1. In a keyboard for a calculator including a face plate, a plurality of key means supported in a predetermined location with respect to the face plate and being arranged to be selectively accessible by a user; the improvement comprising means defining narrow recesses in said face plate in alignment with respective said key means; each recess having a length dimension and a width dimension measured transversely to the length dimension; said dimensions defining an area of the recess; said area being of sufficient size for providing access to the associated key means by a fingernail of a user; said area being of insufficient size for providing access to the associated key means by a finger tip of the user; each key means having an outline extending substantially over the entire width dimension of the respective recess for preventing the user's fingernail from slipping off the key means during depression thereof.

2. A keyboard as defined in claim 1, wherein each said key means is formed of a separate key.

3. A keyboard as defined in claim 1, wherein each said key means has a stem portion extending into the respective recess and substantially filling said recess at least in said width dimension.

4. A keyboard as defined in claim 1, wherein said recesses are constituted by individual slots associated with each said key means.

5. A keyboard as defined in claim 1, wherein said recesses are constituted by at least one continuous slot; a plurality of said key means being aligned with said continuous slot.

6. A keyboard as defined in claim 1, wherein said recesses are constituted by a plurality of parallel, non-intersecting slots; a plurality of said key means being aligned with each said slot.

7. A keyboard as defined in claim 1, wherein said recesses are constituted by a plurality of intersecting slots; a plurality of said key means being aligned with each said slot.

8. A keyboard as defined in claim 7, wherein at least some of said key means are arranged at the intersection of two said slots.

9. A keyboard as defined in claim 1, further comprising rigid fingertip supporting surfaces adjacent each respective key means and adjoining the respective recess; said rigid fingertip supporting surfaces being formed by parts of said face plate.

10. A keyboard as defined in claim 9, wherein each said supporting surface comprises an individual elevation rising from said face plate and sloping upwardly towards one side of an associated key means; further comprising individual ridges rising from said face plate adjacent the respective individual elevations at another side of the respective key means; said recesses being formed of respective clearances between the respective elevation and the associated ridge.

11. A keyboard as defined in claim 9, wherein said key means are arranged in rows; said supporting surfaces being formed by face plate portions extending along each row of said key means; each said face plate portion sloping upwardly towards the respective row of said key means; said recesses being formed of clearances between adjoining face plate portions; each clearance being associated with a row of said key means.

12. A keyboard as defined in claim 1, wherein said face plate is substantially planar and further wherein each key means is in its entirety and in a non-depressed state situated below a plane defined by said face plate.

* * * * *